United States Patent [19]

Ingemansson

[11] 3,999,227

[45] Dec. 28, 1976

[54] APPARATUS FOR TRANSPORTING DISABLED PERSONS

[76] Inventor: Curt Adils Ingemansson, Broby Sjukhus, 280 60 Broby, Sweden

[22] Filed: July 14, 1975

[21] Appl. No.: 595,872

[52] U.S. Cl. ..... 5/86; 5/81 R; 5/89

[51] Int. Cl.[2] ..... A61G 1/02; A61G 7/02

[58] Field of Search ..... 5/81, 83, 86, 87, 89

[56] References Cited

UNITED STATES PATENTS

| | | | |
|---|---|---|---|
| 3,137,011 | 6/1964 | Fischer | 5/86 |
| 3,407,413 | 10/1968 | James | 5/81 R |
| 3,472,224 | 10/1969 | Ewerwahn | 5/89 |
| 3,914,808 | 10/1975 | Woods | 5/86 |

*Primary Examiner*—Casmir A. Nunberg
*Attorney, Agent, or Firm*—John J. Dennemeyer

[57] ABSTRACT

An apparatus for transporting disabled persons comprises a travelling chassis provided with a lifting gear and at least one carrier unit mounted on the lifting gear. Each carrier unit includes two carrier members which extend in parallel spaced relation to each other and are adapted to receive between them at least one sitting or lying support element made of a flexible material.

9 Claims, 3 Drawing Figures

APPARATUS FOR TRANSPORTING DISABLED PERSONS

The present invention relates to apparatus for transporting disabled persons, and of the type comprising a travelling chassis, at least one lifting gear mounted on the chassis, and at least one carrier unit mounted on the lifting gear and including two carrier members extending in spaced parallel relation and adapted to have connected to them at least one sitting or lying support or element made of a flexible material.

In arrangements of the type thus disclosed, the sitting or lying support is mounted, as a rule, on a carrier arm from which it hangs down in an elongated loop. Such sitting or lying arrangements have the disadvantage that the person occupying the sitting or lying support will be subjected to pressure from the seat or lying support proper, and this pressure will be particularly severe if the person in question is heavy. This will mean, for example, that the thighs of a person sitting on the seat will be pressed together, which must be considered to be extremely unsuitable, since patients suffering from thigh or sub-abdominal injuries or after thigh or sub-abdominal operations must not be subjected to such strains and therefore must not be transported on such apparatus.

Attempts have been made towards eliminating this problem by extending the sitting or lying support so as to cause it to extend in a stretched or only slightly sagging condition. When stretched, however, the sitting or lying support will occupy a position at a higher level, involving the drawback that the person to be transported will be at a position which is too high relative to any handles and back-rest of the apparatus. This will make the occupant feel precarious during transportation, particularly if, as it is usually the case, the sitting or lying support will be making pendulous movements.

It is an object of the present invention to obviate these drawbacks and, in an apparatus of the type referred to in the opening paragraph, to provide a sitting or lying support that has a sufficiently stretched condition to eliminate all kinds of squeezing tendencies, at the same time enabling the person to be transported to sit or lie at a very low level relative to the handles, arm-rests and back rest. These advantages are provided by the inventive arrangement as defined in the appended claims.

Figure 1:
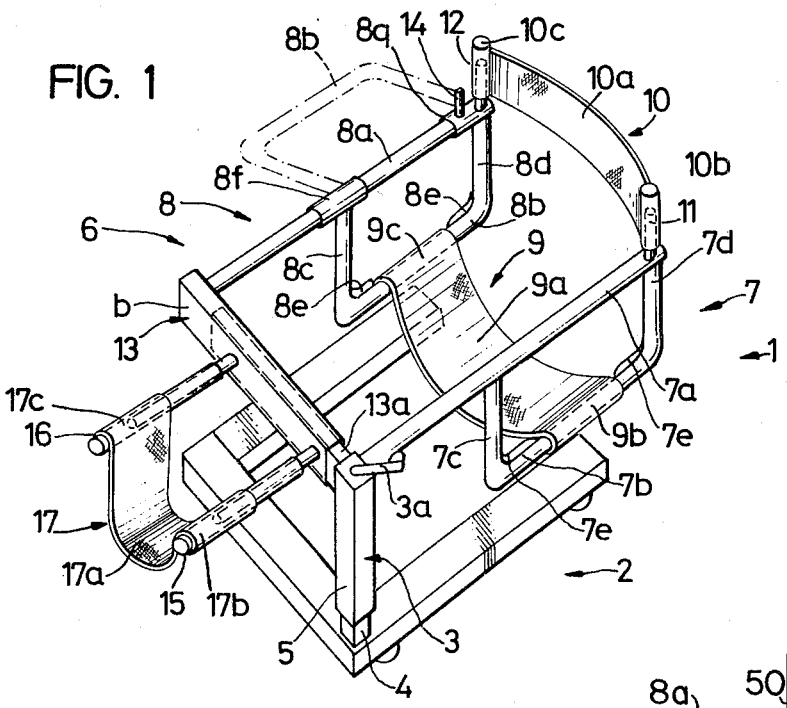
Figure 3:
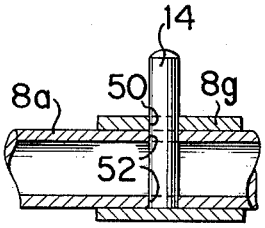
Figure 2:
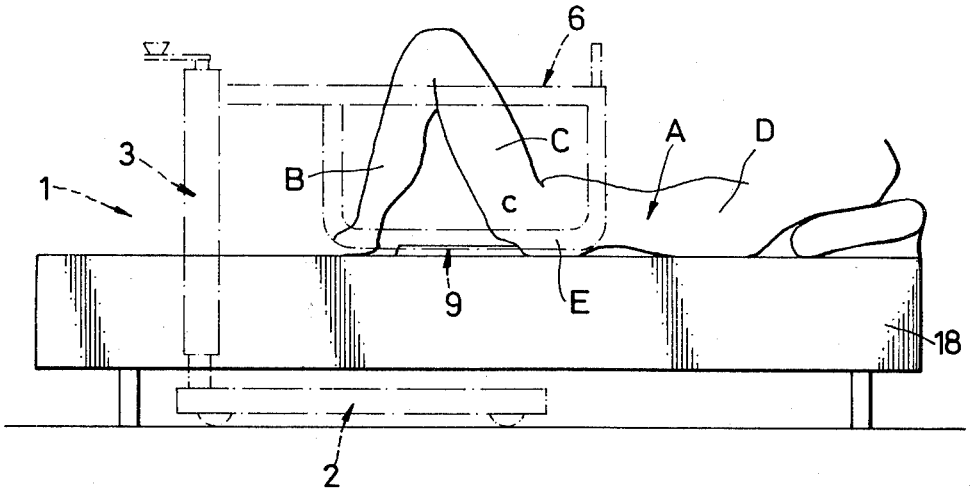

The invention will now be described in greater detail with reference to the accompanying drawings, in which:

FIG. 1 is a perspective view illustrating one arrangement according to the invention, FIG. 2 is a side view illustrating one step in the operation of transferring a person onto an apparatus according to the invention, and FIG. 3 is a longitudinal, vertical sectional view through the locking pin, and the sleeve and strut in which the locking pin is received.

The transport apparatus illustrated in the drawings comprises a wheeled chassis 2 carrying at least one lifting device 3, such as a lifting column consisting of two telescoping parts 4 and 5 adapted to be relatively displaced by a manually or automatically operated power actuator (not shown) of a type known per se. For instance, the part 5 may be displaced relative to the part 4 by using a handle 3*a* to rotate a worm-gear mechanism known per se which is arranged within the lifting device.

Disposed on the lifting device 3 is a carrier unit 6 comprising two relatively spaced carrier members 7 and 8 to which a sitting or lying support 9 of a flexible material can be connected.

For the purpose of ensuring by means of this transporting apparatus that a person to be transported will neither be subjected to pressure from the sitting or lying support, nor be subjected to risks or feel uncomfortable by sitting or lying at a high level relative to the handles, arm- and back-rests, each carrier member 7, 8 has an upper strut 7*a*, 8*a* or the like and essentially spaced therebeneath a lower strut 7*b*, 8*b* or the like, the lower strut 7*b*, 8*b* being adapted to have the sitting or lying support 9 connected to it in such a way that this supporting element will extend between the carrier members 7, 8 without any substantial sagging and at a substantial distance below the upper struts 7*a*, 8*a*.

To enable rapid and reliable connection of the sitting or lying element 9 to the respective struts 7*b*, 8*b*, the flexible portion 9*a* thereof, consisting for example of fabric, plastic sheet or the like, is provided along two opposite sides with hook members 9*b* and 9*c*, respectively, in the form of elongated, rigid parts which are semi-cylindrical in shape whereby they can be hooked from above onto the struts 7*b*, 8*b* and will remain in their hooked-on position when the sitting or lying element 9 is subjected to load. If, for instance, the struts 7*b*, 8 *b* are in the form of cylindrical pipe segments, the hook members 9*b*, 9*c* may be of a cross-sectional shape such that they will extend downward to a generatrix approximately flush with or past the horizontal plane through the axis of the pipe section, thus gripping over substantially half the periphery of the pipe, or slightly more.

To impart stability and at the same time a good-looking appearance to the carrier members 7 and 8, the lower struts 7*b* and 8*b* are interconnected with the upper struts 7*a* and 8*a* by vertical connecting links 7*c*, 7*d* and 8*c*, 8*d*. The joints between the connecting links 7*c*, 7*d* and the strut 7*b*, and between the connecting links 8*c*, 8*d* and strut 8*b* are formed to exhibit, at least outwardly, rounded corners in order to prevent the carrier members 7, 8 from gripping bed linen and the like when moving the carrier members 7, 8 across a bed.

To prevent the hook members 9*b*, 9*c* from sliding along the struts 7*b* and 8*b*, the length of the portion of the struts 7*b* and 8*b* adapted to receive the hook members 9*b*, 9*c* is equal to or only slightly greater than the length of the hook members 9*b*, 9*c*. The length of this portion is limited either by the connecting links 7*c*, 7*d* and 8*c*, 8*d*, respectively, or by stop abutments 7*e*, 8*e* arranged on the struts 7*b*, 8*b*.

To enable the attachment of a back-rest 10, each strut 7, 8 has an upwardly projecting stud 11, 12 and the back-rest comprises a flexible back-supporting element 10*a* provided at opposite sides with sleeves 10*b* and 10*c* adapted to be slid down over studs 11 and 12. Alternatively, each strut 7, 8 may have a hole (not shown) adapted to receive respective mating studs (not shown) fastened to the back-supporting element 10*a*.

The transport apparatus 1 should be movable into such a position relative to a person confined to bed as to enable the patient, in a sitting or lying position on the sitting or lying support 9, to be lifted out of the bed without first having to be moved or turned relative to the bed. For this purpose the lifting device 3 is disposed at one side of the transport apparatus 1, preferably at or adjacent to one of the corners of the transport apparatus 1. One carrier member 7 of the carrier unit 6 preferably extends directly from the lifting device 3 and a carrier arm 13 which carries the second carrier member 8 at its extreme end also extends therefrom.

To avoid the necessity of raising the carrier unit 6 to a level such as to cause the lower struts 7*b*, 8*b* of the carrier members 7, 8 to be disposed above, for instance, a bed-lying patient to be fetched, the connecting struts 8*c*, 8*d* carry sleeves 8*f* and 8*g* which are rotatably mounted on the upper strut 8*a*. As a consequence, the frame member formed by the lower strut 8*b* and the connecting struts 8*c*, 8*d* will be swingable upward from a normal position as shown in full lines in FIG. 1 to an upper position as shown in broken lines in FIG. 1. This swingable frame member can be locked in its normal position and in its upper position and, optionally, in further positions by a locking device which, in its simplest form, may consist, for example, of a pin 14 projecting through an aperture 50 formed in the wall of the sleeve 8*g* and which pin can be caused to engage apertures 52 formed in the upper strut 8*a*. The locking device, however, could be constructed in various other ways, such as in the form of a snap lock of a type known per se.

To be able to vary the spacing between the carrier members 7, 8, the carrier arm 13 may consist of one part 13*a* mounted on the lifting device 3 and a second part 13*b* slidably engaging said one part. The second part can be locked to the part 13*a* in different positions by a pin (not shown) or the like.

The carrier arm 13 has two spaced, parallel, longitudinally projecting holders 15 and 16 on which a supporting member 17 may be mounted for supporting the legs of a person to be transported. The supporting member 17 may comprise, on one hand, a flexible member 17*a*, for instance of cloth or plastic-sheet material, and, on the other hand, two hook members 17*b* and 17*c* which are adapted to be hooked onto the holders 15, 16 from above. Each holder 15, 16 preferably consists of a first part mounted on the carrier arm 13 and a second part slid over the first part and telescopically displaceable along the same as well as being lockable thereto in different positions by a lock-pin or the like. In this way, the disposition of the supporting member 17 can be varied according to the leg-length of the person to be transported.

For the lifting and transportation of a person confined to bed, the transport apparatus 1 can be utilized in the following manner, for example:

In the first place, the sitting or lying support 9 is placed on the bed, underneath the person lying thereon. To carry out such disposition, the legs B of a patient A while bending his thigh and possibly knee joints, are lifted upward until the thighs C form a suitable angle with the patient's body D. This leg-lifting movement is continued until as much as possible of the patient's seat E, at least the lower portion thereof, has been dislodged from the bed or raised to a position above bed 18. Then the sitting or lying support 9 is moved in as far as possible under the seat E. After the patient's legs B have again been lowered so that his or her feet F rest on the bed 18, the patient's lower seat-portions will come to rest on the upper surface of the sitting or lying element 9. Then the patient's legs B, C are lowered to cause the thighs C to rest on the sitting or lying element 9 and the bed 18. Thereafter, optionally, one may fold the sitting or lying element 9 to cause them to contact the person's hip region and then the element can be connected together above the hip region by the aid of straps (not shown) provided with hook connectors (not shown). Thereafter the transport apparatus 1 is moved close to the bed 18, moving the carrier unit 6 inwards across the latter with the framework of the carrier member 8 swung into its upper position and locked in this position. When the carrier members 7, 8 are at either sides of the patient, the frame of the carrier member 8 is swung down into its normal position and is locked in this position. Thereafter the hook members 9*b*, 9*c* of the sitting or lying support 9 are hooked onto the respective lower struts 7*b*, 8*b* by being moved downwardly into engagement with these struts. Next the backrest 10 and, optionally, the supporting element 17 for the patient's legs will be mounted. The patient is then lifted from the bed by operating the lifting device 3, and can then be moved away.

The transport apparatus 1 thus described by way of example is a preferred embodiment of the present invention, although variations thereof may be made in many respects without departing from its principles. As an example of alternative constructions, both carrier members 7, 8 may be swingable to an upper position, and the carrier member 7 could be mounted on the carrier arm 13, for instance on its part 13*a*.

The inventive transport apparatus enables an extremely careful handling of patients in lifting and an exceptionally careful conveyance, giving the patient a strong feeling of security in sitting or lying sufficiently stably during lifting, and lowering and transportation operations.

What is claimed is:

1. Apparatus for transporting disabled persons, comprising: a traveling chassis; at least one lifting means mounted on said chassis; at least one carrier unit mounted on said lifting means, said carrier unit including two carrier members extending in spaced parallel relationship, each of said carrier members including: a substantially rigid upper strut; a substantially rigid lower strut; and means mounting said lower strut beneath said upper strut in spaced, generally parallel relationship, said lower struts being mounted in a normally fixed, spaced apart relationship from each other; a flexible sitting or lying support element; and means on the opposite ends of said flexible support element for connecting said ends with said fixed, spaced apart lower struts, without any substantial sagging in said flexible support element.

2. Apparatus as recited in claim 1, wherein said flexible support element comprises a flexible cloth member, and wherein said means for connecting said ends of said flexible support element comprise elongated hook members connected to the opposite ends of said flexible cloth member, said hook members being adapted to be hooked from above onto said lower struts, and to remain in their hooked-on positions when said flexible support element is subjected to loading.

3. Apparatus as recited in claim 2, further including means on each of said lower struts engageable with said elongated hook members, and arranged to prohibit said hook members from sliding longitudinally of said lower struts.

4. Apparatus as recited in claim 3, wherein said lifting means holds the carrier unit at or adjacent one corner thereof.

5. Apparatus as recited in claim 4, wherein the lower strut on at least one of said carrier members is swingably mounted on its associated upper strut, for swinging from a position substantially below the upper strut to a position essentially at the level of the upper strut, and including additionally locking means selectively engageable to fix said lower strut in said position substantially below said upper strut.

6. Apparatus as recited in claim 5, wherein one of said carrier members is connected to said lifting means by means of a carrier arm, said carrier arm comprising a first part mounted on the lifting means, and a second part telescopically displaceable along said first part, said one carrier member being mounted on said second part of said carrier arm.

7. Apparatus as recited in claim 6, wherein said displaceable part of said carrier arm has holders thereon for mounting a supporting member for supporting the legs of a person to be transported.

8. Apparatus as recited in claim 7, wherein said lifting means is mounted at or adjacent one corner of said traveling chassis.

9. Apparatus as recited in claim 1, wherein said lifting means holds the carrier unit at or adjacent one corner thereof, and wherein said lifting means is mounted at or adjacent one corner of said traveling chassis.

* * * * *